US007252121B2

(12) United States Patent
Hillis

(10) Patent No.: US 7,252,121 B2
(45) Date of Patent: Aug. 7, 2007

(54) URINE DISPOSING APPARATUS AND METHOD

(76) Inventor: Greg Hillis, 7940 E. Camelback Rd., # 312, Scottsdale, AZ (US) 85251

( * ) Notice: Subject to any disclaimer, the term of this patent is extended or adjusted under 35 U.S.C. 154(b) by 161 days.

(21) Appl. No.: 11/111,234

(22) Filed: Apr. 21, 2005

(65) Prior Publication Data

US 2006/0237091 A1 Oct. 26, 2006

(51) Int. Cl.
*B65B 1/04* (2006.01)

(52) U.S. Cl. ..... 141/98; 141/331; 4/449

(58) Field of Classification Search ..... 141/98, 141/364, 331–343; 4/449, 463, 462; 5/604, 5/605

See application file for complete search history.

(56) References Cited

U.S. PATENT DOCUMENTS 1,507,924 A 9/1924 Mabry
2,369,982 A * 2/1945 Richards ..... 141/106
2,591,208 A 4/1952 Seymour et al.
3,757,355 A 9/1973 Allen et al.
4,114,660 A * 9/1978 Arruda ..... 141/98
D259,843 S 7/1981 Murphy
4,638,841 A * 1/1987 Heath ..... 141/98
5,381,839 A * 1/1995 Dowd ..... 141/242
5,390,714 A * 2/1995 North et al. ..... 141/369
5,865,094 A * 2/1999 Kealy ..... 99/291
5,970,529 A 10/1999 Veal
2004/0187200 A1 9/2004 Otto et al.

* cited by examiner

*Primary Examiner*—Steven O. Douglas
(74) *Attorney, Agent, or Firm*—Craig Weiss; Harry M. Weiss; Weiss & Moy, P.C.

(57) ABSTRACT

A urine disposing apparatus and method utilizes a cart-like structure to permit a bed-ridden patient to utilize a single urinal for multiple urinations. Following each use, the contents of the urinal are poured into a director, from which they empty into a receptacle located within the disposing apparatus. The empty urinal may then be re-used and emptied as needed. After a period of use, a caregiver may remove the receptacle, clean the component portions of the apparatus as required, and re-position the apparatus and empty urinal for use by the patient.

19 Claims, 3 Drawing Sheets

Fig. 5
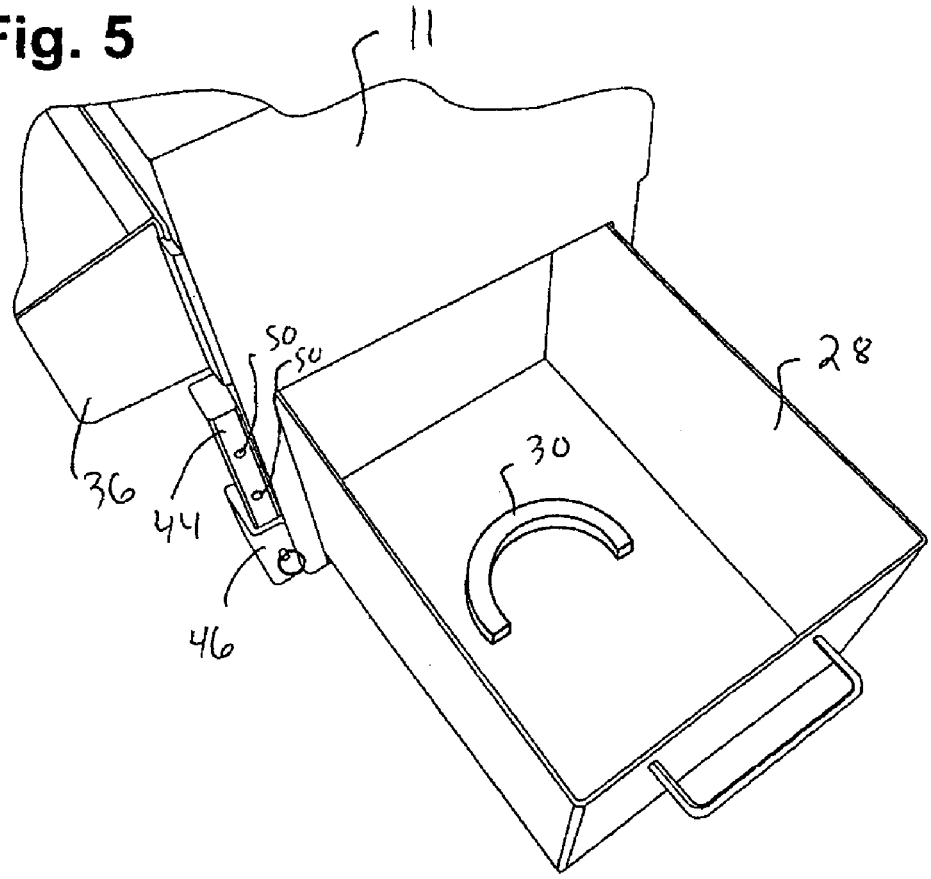
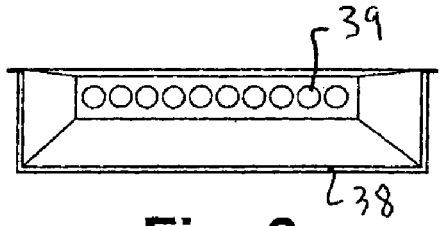
Fig. 6

URINE DISPOSING APPARATUS AND METHOD

FIELD OF THE INVENTION

This invention relates generally to an apparatus and methods for disposing of urine and, more particularly, to an apparatus and method for disposing of a plurality of voids into a single urinal and, from the single urinal, into a urine receptacle.

BACKGROUND OF THE INVENTION

Patients who are confined in a lying position because of infirmity and/or in connection with recovery from surgery or the like are unable to use a standard toilet for purposes of urination. Instead, typically, they must urinate into an open-topped container, known as a urinal. Because the typical patient can be expected to urinate more than a single time in the course of a night, the standard practice is to position several empty urinals in close proximity to the patient. This is often done by hanging empty urinals (which usually have handles) on the bed rail, resting them on a nightstand, or the like.

As each urinal is used, the patient is supposed to place it on a bedside table or similar location, so that it may later be removed by a health care provider. Even where a urinal is not completely filled, a patient will generally be unwilling to further fill it later for fear of spillage, and will instead prefer to position the partially-filled urinal on the table and use an empty urinal for the next urination. As a consequence, at the end of a night, it is not uncommon to find three or four full or partially full urinals on the patient's bedside table.

The need to deal with a plurality of urinals in various states of fullness can be cumbersome for a patient. It is frequently the case that urinals are knocked over, causing the spilling of urine onto the patient, his clothes, and his bedding. Of course, such an event can be extremely upsetting and unpleasant to the patient, and can even be physically harmful to the patient's skin.

A need exists for a urine disposing apparatus and method that permits a patient to utilize a single urinal for multiple voids, with the urinal being capable of being placed by the patient into an empty condition prior to each use. The present invention satisfies this need and provides other, related, advantages.

SUMMARY OF THE INVENTION

In accordance with one embodiment of the present invention, a urine disposing apparatus is provided. The apparatus comprises, in one embodiment: a housing; a director removably coupled to the housing; wherein the director has a substantially funnel-shape configuration having an open upper end and terminating in a spout at a lower end thereof; and a receptacle positionable within the housing below the spout.

In accordance with another embodiment of the present invention, a urine disposing apparatus is provided. The apparatus comprises, in one embodiment: a housing; a handle coupled to the housing; four legs coupled to the housing; at least one wheel coupled to a lower portion of each of the four legs; a director removably coupled to the housing; wherein the director has a substantially funnel-shape configuration having an open upper end and terminating in a spout at a lower end thereof; a side opening along an upper portion of the director; and a receptacle positionable within the housing below the spout; wherein the receptacle is positioned within a drawer coupled to the housing.

In accordance with a further embodiment of the present invention, a method for disposing of urine is provided. The method comprises, in one embodiment: positioning a housing proximate a bed having a patient thereon; wherein the housing has a director removably coupled thereto; wherein the director has a substantially funnel-shape configuration having an open upper end and terminating in a spout at a lower end thereof and wherein the director further has a side opening along an upper portion thereof; positioning the side opening proximate the patient; positioning a receptacle within the housing below the spout; wherein the receptacle is positioned within a drawer coupled to the housing; providing the patient with a urinal and permitting the patient to pour contents of the urinal into the director, and to then re-use the urinal.

BRIEF DESCRIPTION OF THE DRAWINGS

FIG. 5 is a top, perspective view of a component of the urine disposing apparatus of FIG. 1.

FIG. 6 is a top view of a component of the urine disposing apparatus of FIG. 1.

DETAILED DESCRIPTION OF THE PREFERRED EMBODIMENTS

Referring first to FIGS. 1-4, the main components of an embodiment of a urine disposing apparatus 10 (hereinafter "apparatus 10") consistent with an embodiment of the present invention are shown. First, it can be seen generally that the apparatus 10 preferably has a cart-type of configuration, for purposes of providing mobility and ease of use to the caregiver and patient alike. In this regard, the apparatus 10 preferably includes a housing 11 mounted on wheels 12, and includes a handle 14 coupled to the housing 11 for permitting a user to push or pull the apparatus 10 on wheels 12 into a desired position. (It should be noted that, if desired, wheels 12 could be replaced with a low-friction material, such as Teflon®, for purposes of permitting a user to slide the apparatus 10 on a floor surface.)

Figure 3:
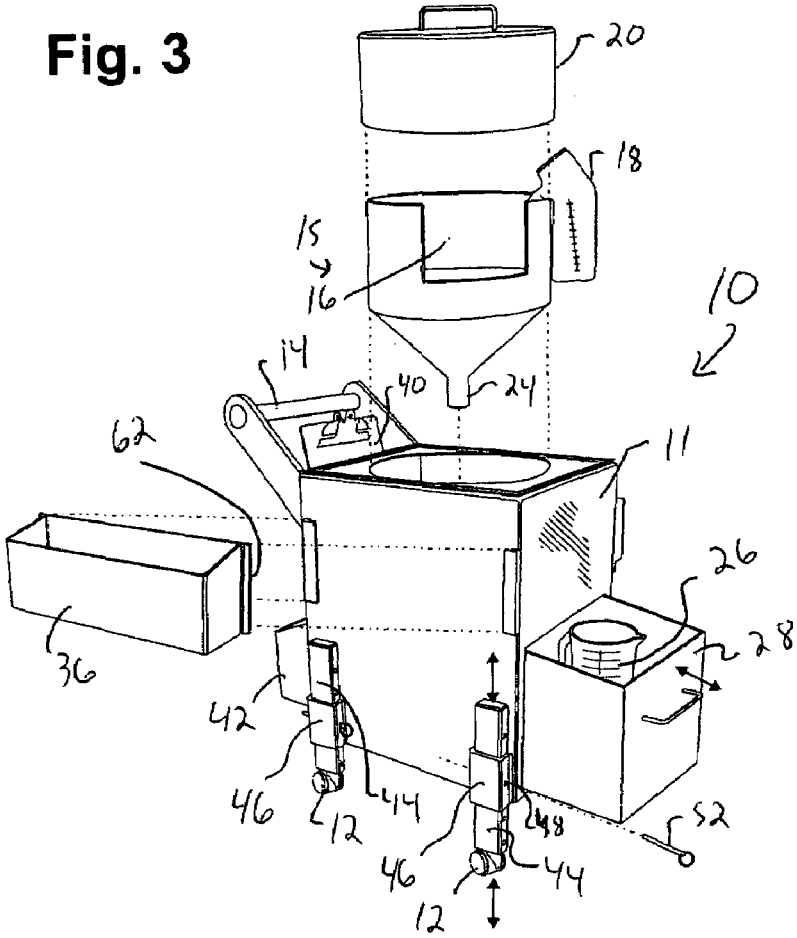
FIG. 3 is an exploded, perspective view of the urine disposing apparatus of FIG. 1.
Figure 4:
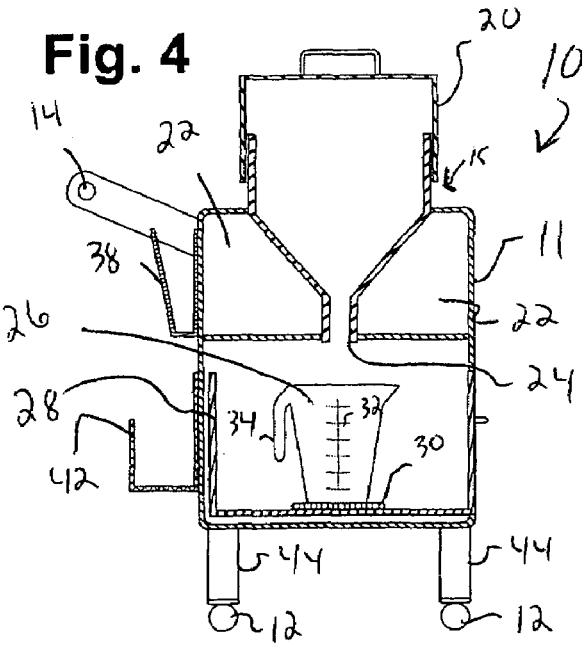
FIG. 4 is a side, cross-sectional view of the urine disposing apparatus of FIG. 1.

Referring specifically to FIGS. 3-4, the apparatus 10 preferably includes a substantially funnel-shaped urine director 15 (hereinafter "director 15"). As best seen in FIG. 3, the director 15 has a side opening 16 along an upper portion thereof, to permit the emptying of a urinal 18 therethrough. Preferably, a cover 20 adapted to fit over the upper portion of the director 15 is provided, for purposes of limiting the travel of odors from the interior of the apparatus 10 after use.

As best shown in FIG. 4, the interior of the housing 11 includes director supports 22, which permit the removable positioning of the director 15 in the housing 11 for use. When in position, the spout 24 of the director 15 is oriented downward, so that urine poured into the director 15 through the upper portion thereof will empty into the interior of the housing 11. More specifically, the director 15 will empty into a receptacle 26, which is located within drawer 28. Referring to FIGS. 4-5, to ensure that the receptacle 26 is positioned in the appropriate location within drawer 28 directly below the spout 24, it is preferred to locate at the bottom of drawer 28 a positioning bracket 30, preferably having a semi-circular configuration, against which a bottom portion of the receptacle 26 may be placed. When so placed, and upon closing of the drawer 28, the receptacle 26 will be properly located below the spout 24.

With particular regard to the receptacle 26, it can be seen that it is preferred to include thereon volume measuring gradations 32. Gradations 32 permit a care giver or other user of apparatus 10 to record the volume of a patient's voids during a period of use—for example, during a night. The receptacle 26 preferably has a handle 34 thereon, to permit the ready removal of the receptacle 26 for emptying and cleaning.

Figure 1:
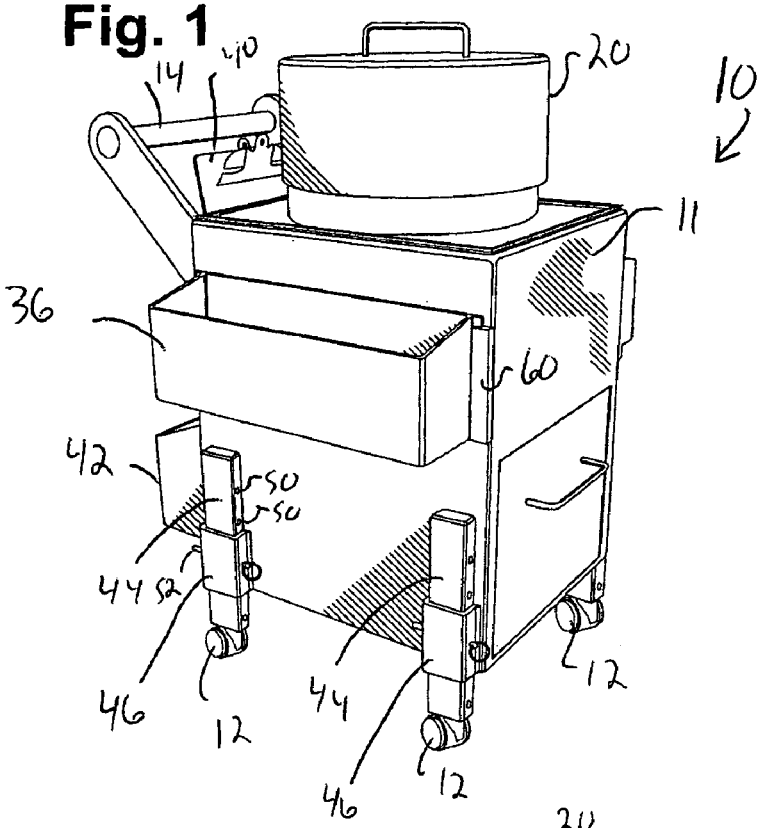
FIG. 1 is a perspective view of an embodiment of a urine disposing apparatus consistent with an embodiment of the present invention, illustrating particularly a first side and a first end of the apparatus.
Figure 2:
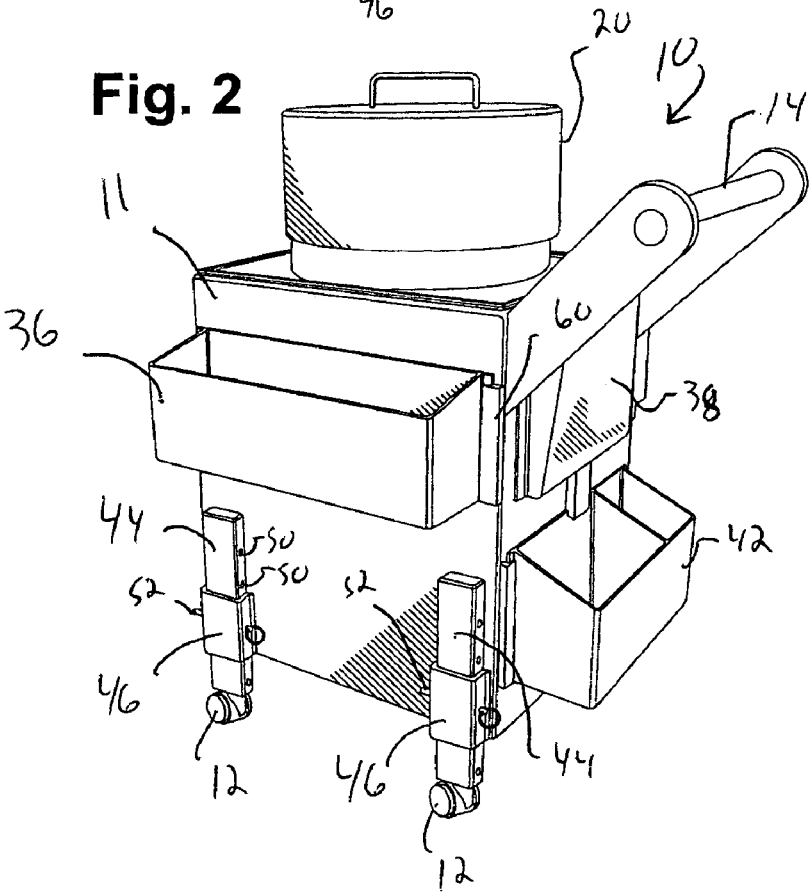
FIG. 2 is a perspective view of the urine disposing apparatus of FIG. 1, illustrating particularly a second side and a second end of the apparatus.

Referring now to FIGS. 1-4 and 6, it is preferred to provide on the housing 11 at least one and preferably a plurality of bins for the convenience of the care giver and/or patient. As shown in FIGS. 1 and 2, for example, right and left side bins 36 may be provided. The side bins 36 may be utilized to hold items that may be useful to the caregiver and/or patient. It may be desired to designate one side bin 36 for the use of the caregiver, and into which items such as gloves, cleaning solution, towelettes and the like may be kept. The other side bin 36 could be designated for the use of the patient, and may hold books, magazines, glasses, a phone, etc. Of course, both bins 36 could be designated for the use of only the patient or only the caregiver, or the use of the bins 36 may be mixed.

As best shown in FIGS. 2, 4 and 6, an upper end bin 38 proximate the handle 14 may be provided. The upper end bin 38 may be used, as shown in FIGS. 1 and 3, for purposes of holding a clipboard 40 having patient data thereon. In this configuration, the clipboard 40 is proximate the handle 14, and thus within ready reach of the user of the apparatus 10. In the preferred embodiment, the upper end bin 38 defines a plurality of apertures 39 (shown in FIG. 6). In the event of spillage of urine during the night, the apertures 39 allow the urine to drain out of the upper end bin 38 in order to protect the contents, such as a clipboard 40 having patient data thereon, of the upper end bin 38 from damage from the liquid. As best seen in FIGS. 1, 3 and 4, a lower end bin 42 may also be provided, below upper end bin 38. The lower end bin 42 may be used to house any desired items, including for example cleaning or other materials used by the caregiver.

As best shown in FIGS. 1 and 3, it is desired to provide for the ready removal of each of the bins 36, 38 and 42 that are herein described, for purposes of cleaning and/or for purposes of customizing the configuration of apparatus 10 for particular uses. The feature of removability may be provided, by way of example, by locating rails 60 on the body of the apparatus 10, into which rails 60 mating lips 62 of the particular bin 36, 38 or 40 may be inserted. So that the bin 36, 38 or 40 will not simply slide through the rails 60 and fall from the apparatus 10, it will be necessary to provide some type of stopping means, such as a closed bottom end for the rails 60, a mating tapering of the rails 60 and the lips 62, the positioning of a bracket on the apparatus 10 (not shown) to contact the underside of the bin 36, 38 or 40 when in proper position, etc.

Referring to FIGS. 1-3 in particular, the apparatus 10 preferably has four legs 44, on the bottom of which are located the wheels 12. Although not required, it is preferred to make legs 44 adjustable in height, so that the level of the apparatus 10 may be changed to accommodate different bed heights, patient needs, or the like. Adjustability of the legs 44 may be provided in numerous different ways. By way of example, adjustability may be provided by locating each leg 44 within a sleeve 46, providing openings 48 through opposing sides of sleeve 46, and providing a plurality of openings 50 through opposing sides of each leg 44. As best seen in FIG. 3, alignment of openings 48 and 50 permits the insertion of pin 52 therethrough, securing leg 44 at the desired height.

It should be noted that the feature of height adjustability may be provided in other manners. For example, it may be desired to provide a raising/lowering mechanism that is either piston or lever actuated, that a user may operate by depressing a pedal or the like.

The apparatus 10 and its related components as herein described may be comprised of any desired material. For example, the use of molded plastic may be desired, because of the qualities of ease of manufacture, light weight, and low cost associated therewith. Alternatively, it may be desired to use stainless steel, for sanitary purposes. Other materials may also be utilized.

STATEMENT OF OPERATION

Initially, the apparatus 10 should be placed in an appropriate position for use by a patient. Typically, this will involve the rolling of the apparatus 10 into a position that is along the side of a patient bed (not shown). If the side bins 36 are in position on the apparatus 10, and if one of the side bins 36 has been designated for use by the patient, it will be preferred to locate the patient's side bin 36 on the side of the apparatus 36 closest to the bed, to provide ease of access to the patient.

Prior to use, the caregiver will position the receptacle 26 within the drawer 28, so that the bottom of the receptacle 26 contacts the bracket 36. The drawer 28 will then be closed, positioning the receptacle 26 below the spout 24.

The caregiver should remove cover 20, and rotate the director 15 so that opening 16 is most proximate the patient. An empty urinal 18 should be placed at a location that is convenient for the patient, and it may be desired to hang it onto a side of the upper portion of the director 15.

A patient having a need to urinate will grasp the empty urinal 18 and urinate therein. The patient will then pour the contents of the urinal 18 into the director 15, through the opening 16. The urine will enter the interior of the director 15, exit the spout 24, and enter the receptacle 26. The patient then restores the empty urinal 18 in a desired location, to be available for its next use—at which time the process will be repeated.

Upon return to the patient, the caregiver may open the drawer 28 to examine the volume and/or color of urine passed by the patient. Such information may be recorded on clipboard 40. The caregiver may then place cover 20 in position over the director 15, and wheel the apparatus 10 to a cleaning area. At such location, any soiled portion of the apparatus 10 may be removed and cleaned—including for example the receptacle 26 and director 15.

While the invention has been particularly shown and described with reference to preferred embodiments thereof, it will be understood by those skilled in the art that the foregoing and other changes in form and details may be made therein without departing from the spirit and scope of the invention.

I claim:

1. A urine disposing apparatus comprising, in combination:

a housing;

a director removably coupled to said housing;

wherein said director has a substantially cylindrical upper portion and a substantially funnel-shape lower portion terminating in a spout at a lower end thereof;

a cover adapted to fit over said upper portion of said director and to extend downward along at least a portion of an outside surface of said upper portion; and a receptacle positionable within said housing below said spout.

2. The urine disposing apparatus of claim 1 further comprising a handle coupled to said housing.

3. The urine disposing apparatus of claim 1 further comprising:

four legs coupled to said housing; and at least one wheel coupled to a lower portion of each of said four legs.

4. The urine disposing apparatus of claim 3 wherein a position of each of said legs relative to said housing is adjustable.

5. A urine disposing apparatus comprising, in combination:

a housing;

a director removably coupled to said housing;

a side opening along an upper portion of said director;

wherein said director has a substantially funnel-shape configuration having an open upper end and terminating in a spout at a lower end thereof; and a receptacle positionable within said housing below said spout.

6. A urine disposing apparatus comprising, in combination:

a housing;

a director removably coupled to said housing;

wherein said director has a substantially funnel-shape configuration having an open upper end and terminating in a spout at a lower end thereof; and a receptacle positionable within said housing below said spout;

wherein said receptacle is positioned within a drawer coupled to said housing; and wherein said drawer has at least two side walls and a front wall so that, when said drawer is in a closed position relative to said housing, said receptacle is concealed from view within an interior portion of said housing.

7. The urine disposing apparatus of claim 6 further comprising a bracket coupled to an interior, bottom portion of said drawer and adapted to facilitate positioning of said receptacle under said spout when said drawer is closed.

8. The urine disposing apparatus of claim 1 further comprising at least one side bin coupled to said housing.

9. The urine disposing apparatus of claim 8 comprising first and second side bins coupled to said housing.

10. The urine disposing apparatus of claim 1 further comprising at least one end bin coupled to said housing.

11. The urine disposing apparatus of claim 10 comprising upper and lower end bins coupled to said housing.

12. A urine disposing apparatus comprising, in combination:

a housing;

a handle coupled to said housing;

four legs coupled to said housing;

at least one wheel coupled to a lower portion of each of said four legs.

a director removably coupled to said housing;

wherein said director has a substantially funnel-shape configuration having an open upper end and terminating in a spout at a lower end thereof;

a side opening along an upper portion of said director; and a receptacle positionable within said housing below said spout;

wherein said receptacle is positioned within a drawer coupled to said housing.

13. The urine disposing apparatus of claim 12 wherein a position of each of said legs relative to said housing is adjustable.

14. The urine disposing apparatus of claim 12 further comprising a cover adapted to fit over said open upper end of said director.

15. The urine disposing apparatus of claim 12 further comprising a bracket coupled to an interior, bottom portion of said drawer and adapted to facilitate positioning of said receptacle under said spout when said drawer is closed.

16. The urine disposing apparatus of claim 12 further comprising at least one side bin coupled to said housing.

17. The urine disposing apparatus of claim 12 further comprising at least one end bin coupled to said housing.

18. A method for disposing of urine comprising:

positioning a housing proximate a bed having a patient thereon;

wherein said housing has a director removably coupled thereto;

wherein said director has a substantially funnel-shape configuration having an open upper end and terminating in a spout at a lower end thereof and wherein said director further has a side opening along an upper portion thereof;

positioning said side opening proximate said patient;

positioning a receptacle within said housing below said spout;

wherein said receptacle is positioned within a drawer coupled to said housing.

providing said patient with a urinal and permitting said patient to pour contents of said urinal into said director, and to then re-use said urinal.

19. The method of claim 18 further comprising adjusting a height of said housing.

* * * * *